US006679004B1

(12) United States Patent
Olberding et al.

(10) Patent No.: US 6,679,004 B1
(45) **Date of Patent: *Jan. 20, 2004**

(54) DECORATIVE COVER FOR RETROFIT DOOR REINFORCEMENT PLATE

(75) Inventors: Ronald E. Olberding, Kansas City, MO (US); David W. Allen, Overland Park, KS (US)

(73) Assignee: Edward Wayne, Inc., Overland Park, KS (US)

( * ) Notice: Subject to any disclaimer, the term of this patent is extended or adjusted under 35 U.S.C. 154(b) by 128 days.

This patent is subject to a terminal disclaimer.

(21) Appl. No.: 09/587,863

(22) Filed: Jun. 6, 2000

(51) Int. Cl.[7] ..... E06B 3/30
(52) U.S. Cl. ..... 49/460; 49/504; 52/734.1
(58) Field of Search ..... 49/460, 504; 52/210, 52/211, 734.1, 738.1, 730.3

(56) References Cited

U.S. PATENT DOCUMENTS

| | | | | |
|---|---|---|---|---|
| ,600,865 A | | 3/1898 | Groves | |
| 1,429,527 A | * | 9/1922 | Paul | 16/389 |
| 2,316,425 A | | 4/1943 | Hasenburger et al. | |
| 2,541,871 A | | 2/1951 | Heijmer et al. | |
| 3,082,490 A | * | 3/1963 | Loucks | 52/734.1 |
| 3,130,455 A | * | 4/1964 | Borlenghi | 49/504 |
| 3,401,487 A | * | 9/1968 | Brandt et al. | 49/504 |
| 3,504,465 A | | 4/1970 | Brinker | |
| 3,609,928 A | * | 10/1971 | Mock | 52/210 |
| 3,681,876 A | * | 8/1972 | Linder et al. | 49/504 |
| 3,800,489 A | | 4/1974 | Boice | |
| 3,888,530 A | * | 6/1975 | Fabrici | 292/340 |
| 3,899,259 A | | 8/1975 | Boice | |
| 3,918,207 A | | 11/1975 | Aliotta | |
| 3,940,900 A | | 3/1976 | Russo | |
| 3,963,269 A | * | 6/1976 | Rosenberg | 292/346 |
| 4,005,890 A | * | 2/1977 | Murch | 292/346 |
| 4,122,633 A | * | 10/1978 | Holdiman | 49/501 |
| 4,167,088 A | | 9/1979 | Governale | |
| 4,171,836 A | | 10/1979 | St. Aubin | |
| 4,214,405 A | | 7/1980 | Chupik | |
| 4,223,494 A | | 9/1980 | Wendt | |
| D259,856 S | | 7/1981 | Ciener | |
| 4,281,481 A | * | 8/1981 | Wendt | 49/504 |
| 4,330,972 A | * | 5/1982 | Sailor | 52/211 |
| 4,389,817 A | | 6/1983 | Olberding | |
| 4,415,191 A | * | 11/1983 | Thorp | 292/346 |
| 4,416,087 A | * | 11/1983 | Ghatak | 49/462 |
| 4,489,517 A | | 12/1984 | Young | |
| 4,547,009 A | * | 10/1985 | Allen | 292/364 |

(List continued on next page.)

FOREIGN PATENT DOCUMENTS

DE 100 26 284 A1 * 7/2000

OTHER PUBLICATIONS

Don–Jo Manufacturing, Inc. Catalog entitled "Lock Accessories" (Sep., 1992).

*Primary Examiner*—Gregory J. Strimbu
(74) *Attorney, Agent, or Firm*—Hovey Williams LLP

(57) ABSTRACT

The door reinforcement assembly includes a reinforcement plate secured to the interior surface of one of the door jambs in an overlying relationship with a projection of the door hardware. A portion of the reinforcement plate is visible when it has been secured to the door jamb, and a decorative cover is retained on the plate to conceal the visible portion thereof. The decorative cover and reinforcement plate are preferably configured so that the cover is retained without the use of fasteners (e.g., the cover snaps onto the reinforcement plate). The door hardware associated with the reinforcement plate may comprise a strike plate or an inventive high security door hinge. The high security door hinge includes a door plate fastened to the door, a jamb plate fastened to the corresponding jamb and pivotally interconnected with the door plate, and a reinforcement projection projecting transversely from each of the plates to engage and extend along the interior surface of the door or jamb.

34 Claims, 3 Drawing Sheets

U.S. PATENT DOCUMENTS

D283,299 S 4/1986 Mazie
4,635,399 A 1/1987 Gehrke et al.
4,684,160 A * 8/1987 Nelson ..... 292/340
4,690,445 A * 9/1987 Hartley ..... 292/341
4,717,185 A * 1/1988 Hartley ..... 292/340
4,770,452 A 9/1988 Petree, Jr.
4,858,384 A * 8/1989 Blankenship ..... 49/460
4,953,901 A 9/1990 Hegdahl
D313,162 S 12/1990 Westphal et al.
5,011,215 A 4/1991 Kalina
5,016,930 A 5/1991 Hamilton
5,031,946 A 7/1991 Yarrow
5,070,650 A 12/1991 Anderson
5,074,606 A * 12/1991 Priola et al. ..... 292/340
5,094,489 A 3/1992 Jones
5,127,690 A 7/1992 Kim et al.
5,171,050 A 12/1992 Mascotte
5,222,343 A * 6/1993 Anderson ..... 52/718.04
5,230,180 A * 7/1993 Tweedt et al. ..... 49/400
5,241,790 A 9/1993 Schimpf
D351,781 S 10/1994 DeWitt
5,365,697 A 11/1994 Vanderpan
5,412,909 A * 5/1995 Wu ..... 49/505
5,456,507 A 10/1995 Jones
5,474,347 A 12/1995 Vigneault et al.
5,566,509 A * 10/1996 Long ..... 49/462
5,566,995 A 10/1996 Jagiela
5,570,917 A * 11/1996 Cutrer ..... 16/392
5,581,948 A 12/1996 Simonsen
5,619,823 A 4/1997 Ruff et al.
5,640,808 A * 6/1997 Simeone et al. ..... 49/504
5,645,330 A 7/1997 Artwohl et al.
5,647,172 A 7/1997 Rokicki
5,678,871 A * 10/1997 Zarzycki ..... 292/346
5,727,349 A 3/1998 McLaughlin
5,752,728 A 5/1998 Matouschek
5,757,269 A 5/1998 Roth et al.
5,836,118 A * 11/1998 Thronton et al. ..... 52/204.1
5,836,628 A * 11/1998 Beier ..... 292/346
5,901,510 A * 5/1999 Ellingson ..... 52/210
5,934,024 A 8/1999 Simpson

* cited by examiner

DECORATIVE COVER FOR RETROFIT DOOR REINFORCEMENT PLATE

BACKGROUND OF THE INVENTION

1. Field of the Invention

The present invention relates generally to fenestration products, such as a door assembly, for installation into a house or building. More particularly, the present invention concerns a decorative cover that serves to conceal a reinforcement plate extending along the inside face of the door frame. The present invention also particularly concerns an improved door hinge design.

2. Discussion of Prior Art

As noted in our previous application for U.S. patent Ser. No. 09/128,517 filed Aug. 3, 1998, protection against unauthorized entry into a building is highly contingent on the security provided by the exterior door(s). We have also recognized the importance of reinforcing a standard door assembly, such that the risk of unauthorized entry into the building is reduced with minimal modification to the assembly or its components. It is specifically disclosed in our previous application that significant reinforcement of a standard door assembly can be accomplished by securing the transverse projection of an inventive strike plate against the interior surface of the door jamb and, more preferably, overlying the projection with a reinforcement plate extending the length of the interior surface. Along with other advantages, such arrangements ensure that the bolts of the latch and lock mechanisms experience moment loads that are significantly less than what might otherwise be experienced when a large impact force is exerted against the exterior of the door.

However, we have determined that it would also be beneficial to reinforce the hinge side of the door, particularly in sidelighted door assemblies. In addition, with respect to the arrangement including the reinforcement plate, we have found that attachment of standard wood trim over the plate is burdensome. Although we have adhered a paintable or stainable laminate to the front face of the reinforcement plate, this approach is also burdensome and does not serve to completely cover the reinforcement plate.

OBJECTS AND SUMMARY OF THE INVENTION

Responsive to these and other problems, an important object of the present invention is to provide an apparatus that reduces the risk of intrusion through a door assembly. It is also important that this object be achieved in a timely and inexpensive manner. Another important object of the present invention is to reinforce a standard door assembly with minimal modification or additions thereto. In addition, it is specifically an important object of the present invention to reinforce the hinge side of the door assembly, preferably to the same extent as the strike plate side. Yet another important object of the present invention is to provide a reinforced door assembly that is easily and inexpensively trimmed. It is particularly an important object of the present invention to eliminate the trimming problem presented by the arrangement(s) disclosed in our previous application.

In accordance with these and other objects evident from the following description of the preferred embodiment, the present invention concerns a door reinforcement assembly including a elongated reinforcement plate adapted to be secured against the interior or exterior surface of one of the door jambs. Most preferably, the reinforcement plate overlies the transverse projection of door hardware fastened to the door jamb. A decorative cover conceals the reinforcement plate from view, and the former preferably includes a paintable, pre-stained or stainable outer surface. Moreover, the decorative cover may be configured so as to be automatically retained on the reinforcement plate when it is positioned to conceal the plate from view. Such interconnection is preferably accomplished without fasteners so that the outer surface of the cover may be continuous and unperforated. The present invention also concerns a method of reinforcing a door assembly, in which a reinforcement plate is concealed by a decorative cover that is attached to the former without the use of fasteners. The present invention further concerns a high security door hinge that has a reinforcement projection for engaging and extending along the interior or exterior surface of the jamb, preferably in an underlying relationship with the reinforcement plate.

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
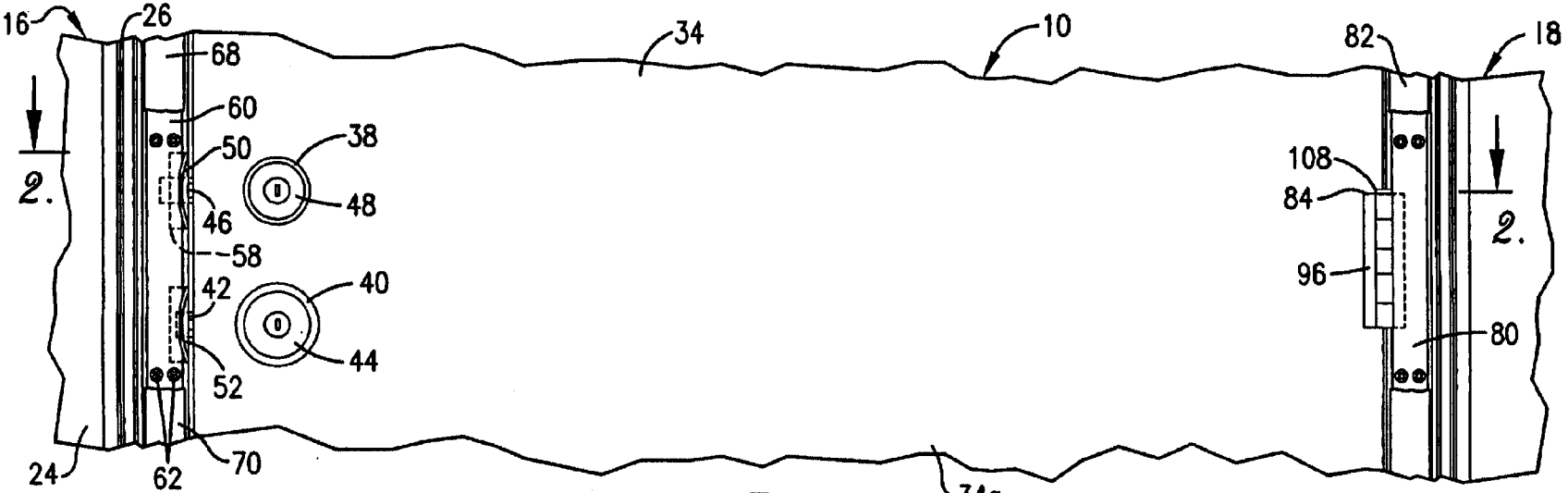
FIG. 1 is a fragmentary elevational view of the inside of a door assembly constructed in accordance with the principles of the present invention, with components thereof being partially broken away to reveal the reinforcement plate and door hardware.

Turning initially to FIG. 1, the door assembly 10 selected for illustration is designed to be installed within a suitable opening (not shown) of a building frame (also not shown). It shall be understood that the term "building" as used herein means any structure having an interior which may be accessed through a door assembly (e.g., houses, multi-dwelling structures, commercial structures, etc.). The illustrated door assembly 10 includes an open framework comprising a pair of laterally spaced door jambs 12 and 14 (see FIG. 2) extending between the floor (not shown) and header (not shown) of the building frame, an upper crossbeam (not shown) extending between the jambs 12 and 14 adjacent the header, and a lower sill (not shown) extending between the jambs 12 and 14 adjacent the floor. The door assembly framework is preferably formed of wood.

In the illustrated embodiment, the door assembly 10 is accompanied by a pair of sidelight assemblies 16 and 18. Turning first to the left sidelight assembly 16, it includes an open framework having a pair of laterally spaced, upright jambs 20 (only the right jamb being shown in the drawing figures) extending between the floor and header, an upper cross-beam (not shown) extending between the jambs 20 adjacent the header, and a sill 22 extending between the jambs 20 adjacent the floor. The window framework is also preferably formed of wood. The jambs 20, cross-beam and sill 22 cooperatively support a glass window 24 therebetween. In the usual manner, the sidelight assembly 16 includes trimming 26 extending around the perimeter of the window 24 for mounting the window 24 in the framework and enhancing the appearance of the assembly 16. It is particularly noted that the right window jamb 20 cooperates with the left door jamb 12 to define a mullion 28 between the two assemblies 10 and 16. The right sidelight assembly 18 is preferably virtually identical in construction to the left assembly 16, and it shall therefore be sufficient to explain that the left window jamb 30 of the assembly 18 cooperates with the right doorjamb 14 to define a right mullion 32. Although the illustrated mullions 28 and 32 are formed of two interconnected jambs, it is entirely within the ambit of the present invention to form each mullion of a single, unitary piece of material, as will be described.

If desired, the door assembly 10 may be provided with only one of the sidelight assemblies 16 or 18. Furthermore, the principles of the present invention are equally applicable to a door assembly associated with no sidelight assemblies such that the door assembly is installed between a pair of laterally spaced cripples (not shown) of the building frame (a so-called "single door application").

Figure 2:
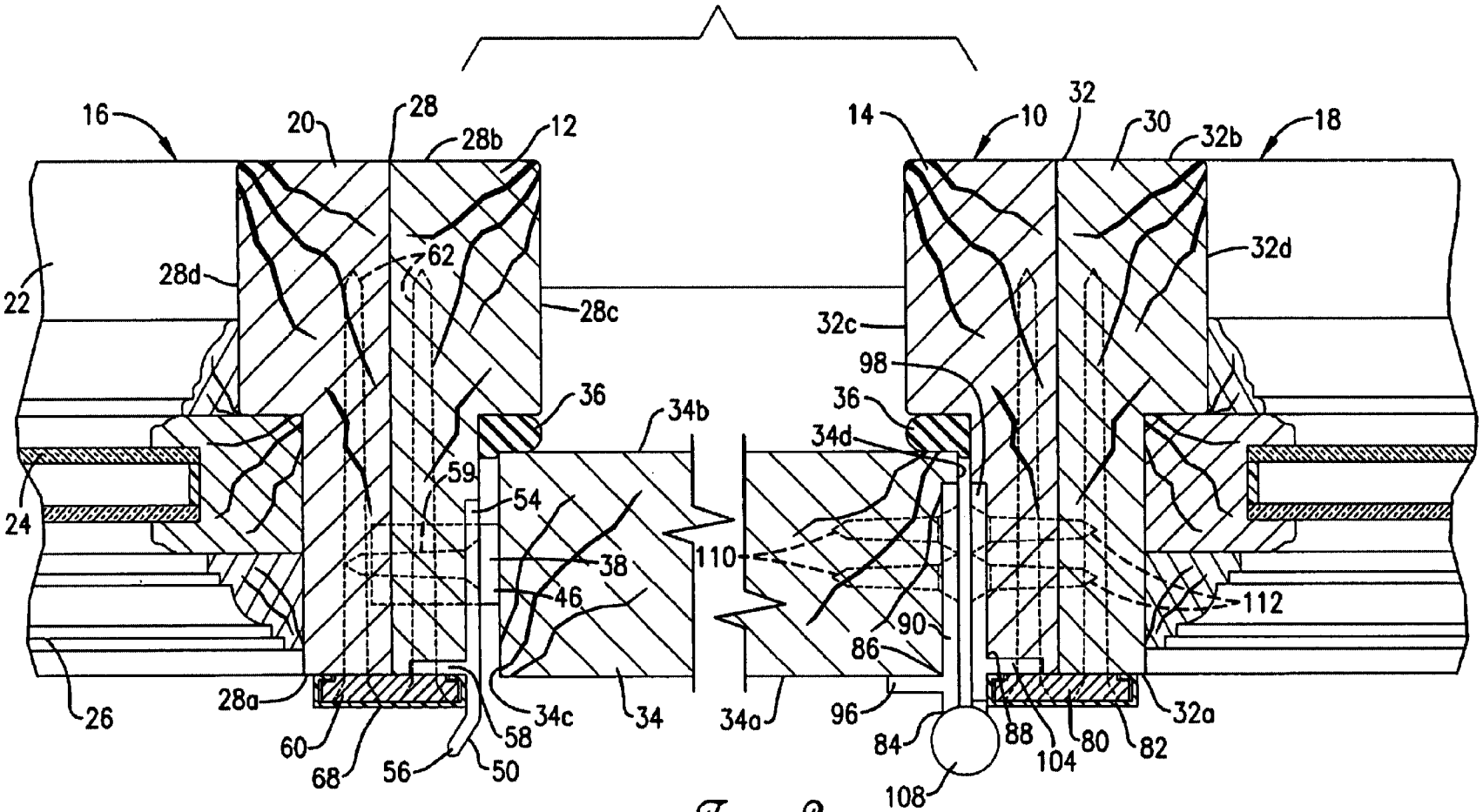
FIG. 2 is horizontal cross-sectional view taken generally along line 2—2 of FIG. 1.
Figure 3:
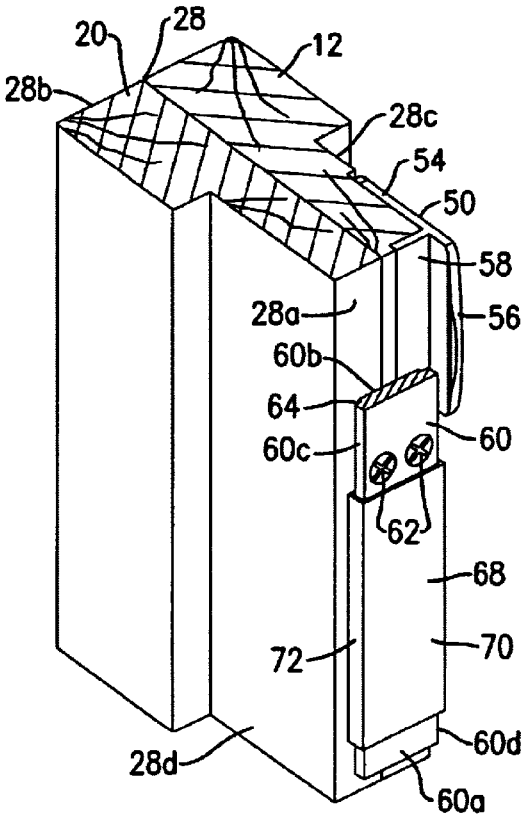
FIG. 3 is a fragmentary perspective view of the left mullion, particularly illustrating the relationship of the strike plate, reinforcement plate and decorative cover.
Figure 4:
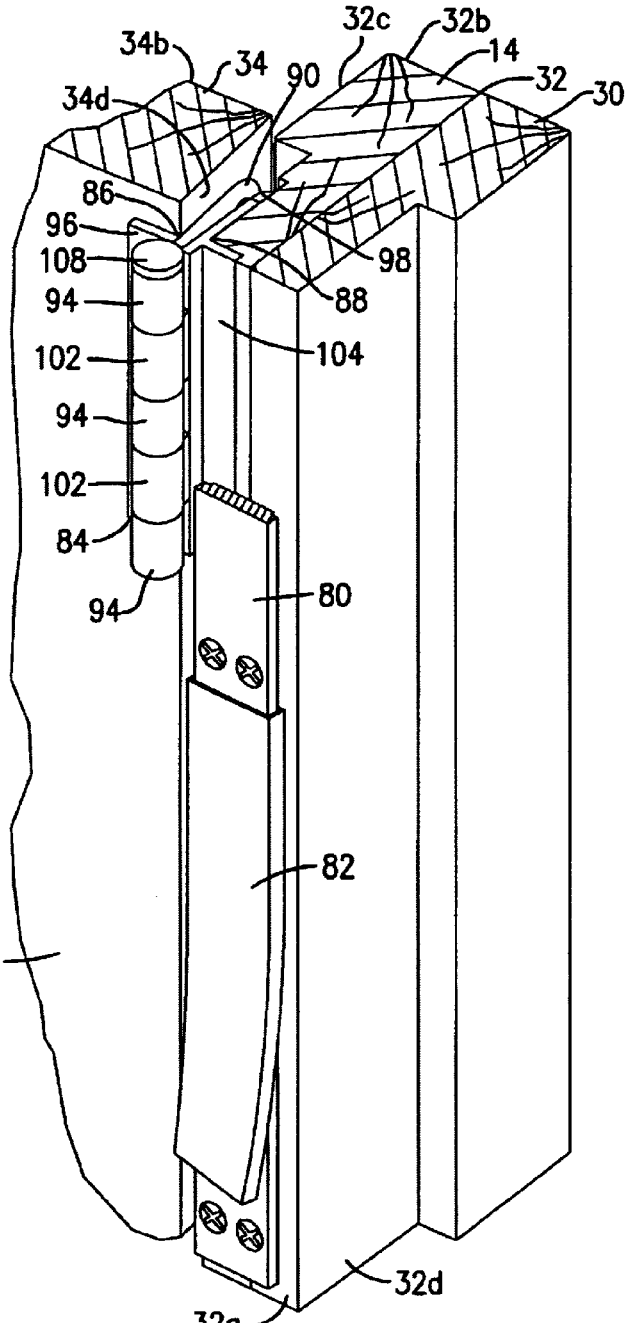
FIG. 4 is a fragmentary perspective view of the right mullion, particularly illustrating the relationship of the door hinge, reinforcement plate and decorative cover.

The left mullion 28 presents opposite interior and exterior surfaces 28*a* and 28*b* and opposite door and window faces 28*c* and 28*d* (e.g., see FIGS. 2 and 3). The right mullion 32 similarly has faces 32*a*, 32*b*, 32*c*, 32*d* (e.g., see FIGS. 2 and 4). It is also noted that each of the jambs 10,12,20,30 is generally rectangular in shape with a thick, longitudinally extending portion adjacent the exterior surface thereof and a relatively thinner, longitudinally extending portion adjacent the interior surface thereof (see particularly FIG. 2). In this regard, the thin interior portions of the door jambs 12 and 14 define a space therebetween that is wider than the space defined between the thick exterior portions thereof. Moreover, the door assembly 10 includes a door 34 dimensioned to be received between the interior portions of the jambs 12 and 14 when the door 34 is closed. Those ordinarily skilled in the art will appreciate that the thick exterior portions of the jambs 12 and 14 significantly inhibit access to the interiorly disposed door hardware, and the thick portion of the left jamb 12 serves as a stop for preventing outward swinging of the door 34 beyond its closed position. As is customary, a padding/insulating strip 36 is provided along the step defined between the exterior and interior portions of each door jamb 12 and 14.

In the usual manner, the door 34 presents opposite, flat interior and exterior surfaces 34*a* and 34*b* and opposite side faces 34*c* and 34*d*. Preferably, the interior surface 34*a* of the door 34 is substantially coplanar with the interior surfaces 28*a* and 32*a* of the mullions 28 and 32 when the door 34 is closed (see FIG. 2). Further, the side faces 34*c* and 34*d* of the door 34 are preferably in an opposed relationship with the inner faces 28*c* and 32*c* of the respective mullions 28 and 32 when the door 34 is closed. The door 34 is preferably formed of wood, although other suitable materials may be used.

In the illustrated embodiment, the door is swingably mounted to the right mullion 32, although this orientation may be reversed if desired. With respect to the opposite side of the door 34, a standard lock mechanism 38 and standard latch mechanism 40 are mounted to the door 34. In the usual manner, the latch mechanism 40 includes a spring-biased bolt 42 (see FIG. 1) reciprocally mounted to the door 34 and urged outwardly to be automatically inserted into a bolt-receiving opening (not shown) in the mullion 28 when the door 34 is closed, thereby releasably retaining the door in its closed position. A rotatable interior handle 44 is coupled with the bolt 42 to shift the latter out of the mullion opening, and thereby unlatch the door 34, when it is desired to swing the door 34 out of its closed position. As is custom, the outer end of the latch bolt 42 has an arcuate camming face (not shown) which cooperates with structure mounted to the left doorjamb 12 to automatically shift the bolt 42 against the spring-bias as the door 34 is swung to the closed position.

On the other hand, the lock mechanism 38 serves to lock the door 34 in its closed position. The lock mechanism 38 similarly includes a bolt 46 mounted to the door 34 for reciprocating movement into and out of an upper bolt-receiving opening in the left mullion 28. However, the lock bolt 46 is not spring-biased, but rather an interior hand-operated turnscrew 48 serves to control reciprocating movement of the bolt 46, along with a key-operated cylinder (not shown) mounted to the exterior surface 34*b* of the door 34. As indicated in FIG. 2, the upper bolt-receiving opening extends into the window jamb 20 so that a high security lock mechanism with an extended bolt throw may be utilized. Of course, if the left sidelight assembly 16 is not provided with the door assembly 10, the upper bolt-receiving opening would preferably extend into the adjacent cripple (not shown) of the building frame. The lower bolt-receiving opening for the latch bolt 42 may similarly extend into the window jamb 20.

As shown in FIG. 1, the door assembly 10 preferably includes strike plates 50 and 52 mounted adjacent the bolt-receiving openings in the left mullion 28. The strike plates 50,52 are identical in construction and are each similar to the inventive strike plate shown in our prior application identified above, said application being hereby incorporated by reference herein as is necessary for a full and complete understanding of the present invention. It shall therefore be sufficient to explain that the upper strike plate 50 includes a flat body 54 that is placed along the face 28*c* of the mullion 28, a bolt-receiving hole (not shown) defined in the body and aligned with bolt 46, a cam element 56 projecting interiorly from the body 54 beyond the surface 28*a*, and a reinforcement projection 58 projecting transversely from the body 54 and engaging and extending along the interior surface 28*a* of the mullion 28. As perhaps best shown in FIG. 2, the strike plate 50 is preferably rabbeted into the doorjamb 12, although this is not required. The strike plate 50 is secured to the jamb 12 by any suitable means, such as the illustrated screws 59.

Similar to our prior application, the door assembly 10 also includes a reinforcement plate 60 secured against the interior surface 28*a* of the mullion 28 in an overlying relationship with the projection 58. The reinforcement plate 60 preferably extends the full the length of the mullion 28 but is slightly narrower than the lateral dimension defined between the faces 28*c* and 28*d* (e.g., see FIG. 5). For example, a standard wood mullion will have a lateral dimension of approximately one and one-half inches and, in such a case, the reinforcement plate 60 preferably has a width of approximately one and one-sixteenth inches. The reinforcement plate 60 is preferably secured to the mullion 28 by long screws 62 (e.g., screws having a length of three inches) that are arranged in vertically spaced pairs. However, other suitable fasteners and various other screw arrangements (e.g., vertically staggered screws) may be used. It is noted that the plate 60 may alternatively be shorter than the mullion 28 so that the installer may vary the location of the plate 60 to ensure that the attachment screws 62 and lock and latch mechanisms 38,40 do not interfere with one another.

Again, the strike plate 52 for the latch mechanism 40 is similar to the plate 50 and includes a projection that engages and extends along the interior surface of the doorjamb 12 in an underlying relationship with the reinforcement plate 60.

Figure 5:
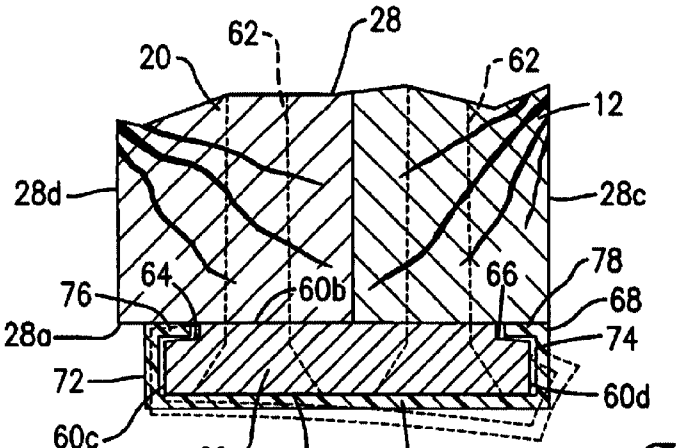
FIG. 5 is a horizontal cross-sectional view of the interior portion of the left mullion also taken along line 2—2 of FIG. 1 but having the strike plate removed, particularly illustrating the manner in which the decorative cover is attached to the reinforcement plate.

The illustrated reinforcement plate 60 has a generally rectangular cross-sectional shape to define a flat front face 60*a*, an opposite flat rear face 60*b*, and a pair of side faces 60*c* and 60*d* (see FIG. 5). In this regard, the reinforcement plate 60 is very similar to that shown in our previous application; however, it does differ in one major respect. In particular, the reinforcement plate 60 includes recesses 64 and 66 defined in the sides thereof 60*c* and 60*d*, respectively, along the rear face 60*b*. The recesses 64 and 66 preferably extend the full length of the plate 60.

When the reinforcement plate 60 is secured against the interior surface 28*a* of the mullion 28, the front face 60*a* and side faces 60*c*, 60*d* are visible (see FIG. 3). As noted in our previous application, the reinforcement plate 60 is formed of metal, such as aluminum, which is difficult to decorate (e.g., paint) and therefore believed to be unsightly. Because of the narrowness of the mullion 28, it is a practical impossibility to overlie the plate 60 with wood trim that has been rabbeted to receive the plate 60. As noted in the Background of the Invention, we have adhered a laminate (not shown) to the front face of our previous reinforcement plate (i.e., the plate shown in our previous application) so that the laminate may be painted or stained to match the mullion. However, we have found this to be time consuming, difficult and somewhat lacking in the sense that the reinforcement plate is not completely covered.

The latch-side reinforcement components illustrated herein include a decorative cover 68 that conceals the reinforcement plate 60 from view. The preferred cover 68 includes a flat front wall 70, a pair of sidewalls 72 and 74 extending rearwardly from the front wall 70, and a pair of lips 76 and 78 each projecting inwardly from the rear edge of a respective one of the sidewalls 72 and 74. As shown in FIG. 5, the cover 68 consequently defines a cavity for snugly receiving the reinforcement plate 60 therein. The cover 68 is preferably coextensive with the reinforcement plate 60. It is particularly noted that the front wall 70 engages and overlies the front face 60*a* of the plate 60, while the sidewalls 72 and 74 overlie the side faces 60*c* and 60*d*. That is, the illustrated decorative cover 68 completely overlies and conceals the reinforcement plate 60. Further, each of the lips 76 and 78 are received in a respective one of the recesses 64 and 66 to thereby retain the cover 68 on the plate 60. In this regard, the illustrated cover 68 is attached to the plate 60 without the use of fasteners such as screws, rivets, nut-and-bolt assemblies, etc. In addition, it is not necessary to provide any holes in or otherwise pierce the outside surface of the decorative cover 68.

It will be appreciated that the illustrated cover 68 is consequently attached to the plate 60 after the latter has been fastened to the mullion 28. The cover 68 must consequently have sufficient flexibility to elastically bend over the plate 60 until the lips 76 and 78 are received in the recess 64 and 66. We have found such a "snap on" attachment to be easily performed and highly reliable. The decorative cover is formed of any suitable material having sufficient flexibility to wrap around the reinforcement plate 60, as well as strength and durability to remain captured on the reinforcement plate 60. It is believed that a number of plastic materials are particularly well suited for the cover 68, high impact polystyrene being most preferred, although other suitable materials (e.g., fiberglass, powder-coated aluminum, etc.) may be used.

The illustrated front wall 70 and sidewalls 72 and 74 present a smooth, imperforate, continuous outside surface that conceals the reinforcement plate 60 and screws 62. The cover 68 may consequently be decorated (e.g., painted) without any modification and little or no "prep" work. The cover 68 is most preferably formed of a paint grade plastic so that it may be painted along with the mullion 28. If desired, a small bead of a suitable filler material (e.g., caulk) may be provided along each of the corners defined between the front face 28*a* of the mullion 28 and the sidewalls 72 and 74. The outside surface of the cover 68 may be provided with a wood-type laminate that is either prestained or stainable. The laminate may be formed of faux or real wood veneer. It is only necessary to provide the laminate on the front wall 70 and sidewalls 72 and 74, however, the laminate may also be provided on the lips 76 and 78 to simplify fabrication of the cover 68. It is noted that the outer surface defined by each of the walls 70,72,74 is flat, although the principles of the present invention are equally applicable to a cover having grooves or other finishing-type contours defined along the outer surfaces.

In the illustrated embodiment, the reinforcement plate 60 and cover 68 are dimensioned and located so that the sidewall 72 of the cover 68 engages the flat body of each of the strike plates 50 and 52 but is otherwise spaced from the door face 28*c* of the mullion 28. The left side wall 72 of the cover 68 is similarly spaced slightly from the outer face 28*d* of the mullion 28 (see FIG. 2). However, the reinforcement plate 60 and decorative cover 68 may be variously sized and shaped (e.g., the plate 60 and cover 68 may alternatively be arranged so that the sidewall 72 is flush with the outer face 28*d*). It is also within the ambit of the present invention to retain the cover 68 on the reinforcement plate 60 in various other suitable manners. For example, the recesses 64 and 66 and lips 76 and 78 need not extend the full length of the plate 60 and cover 68. But rather, the plate may alternatively include vertically spaced slots that receive similarly spaced lips whereby longitudinal shifting of the decorative cover relative to the plate is restricted.

In view of the foregoing, installation of the latch-side reinforcement components involves securing the strike plates 50 and 52 to the mullion 28 (note, the flat body and reinforcement projection of each of the strike plates is mortised into the door jamb 12). The reinforcement plate 60 is attached to the interior surface 28*a* by long wood screws 62, and this step may be performed before or after the strike plates 50 and 52 have been attached. Once the reinforcement plate 60 has been secured in place, the decorative cover 68 is snapped onto the plate 60. If desired, the strike plates 50 and 52 may be installed after the cover 68 has been attached to the plate 60. It will be appreciated that attachment of the decorative cover 68 involves flexing the cover over the reinforcement plate 60. As shown in FIG. 5, one of the lips is preferably inserted into the corresponding recess and then the opposite side of the cover 68 is flexed around the reinforcement plate 60. It is believed that the simplest installation method involves flexing the cover 68 in this manner adjacent one of its ends; if not already aligned, generally aligning that end of the cover 68 with the corresponding end of the mullion 28 by sliding the cover along the plate 60; and then simply snapping the remaining portion of the cover 68 onto the plate 60 by pressing against the front wall 70. It may be said that the decorative cover 68 is automatically retained on the reinforcement plate 60 when the former is placed in a covering relationship with the latter; that is, overlying the reinforcement plate 60 with the decorative cover 68 causes the latter to be retained on the former.

Figure 6:
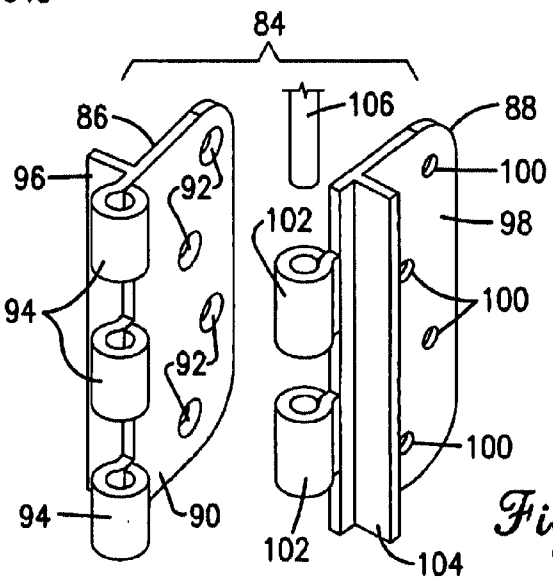
FIG. 6 is an exploded, fragmentary perspective view of the inventive door hinge.

The hinge-side of the door assembly similarly includes a reinforcement plate 80 and decorative cover 82, which are virtually identical to the plate 60 and cover 68 and will therefore not be described in detail. Moreover, the hinge-side reinforcement components include a plurality of inventive hinges 84 (only one being shown in the drawing figures) for swingably mounting the door 34 to the right mullion 32. The hinges 84 significantly enhance the security of the door assembly 10 by further reducing the risk of intrusion gained by exerting a large impact load against the exterior surface 34*b* of the door. As perhaps best shown in FIG. 6, the hinge includes a door attachment member 86 and jamb attachment member 88 that are swingably interconnected. The door attachment member 86 preferably includes a generally rectangular door plate 90 having a plurality of screw-openings 92 defined therein. As is customary, from one side of the plate 90 projects three vertically spaced sleeves 94. A reinforcement projection 96 extends transversely from the plate 90 proximal to the sleeved side thereof. The jamb attachment member 88 similarly includes a jamb plate 98 having a plurality of screw-receiving openings 100, a pair of sleeves 102 projecting from one side of the plate 98, and a reinforcement projection 104 extending transversely from the plate 98. A pin 106 having an upper, enlarged head 108 is received in the sleeves 94 and 102 to swingably interconnect the attachment members 86 and 88.

As perhaps best shown in FIG. 2, the door plate 90 is secured to the side face 34*d* of the door 34 by screws 110 inserted through the openings 92. Although not required, the door plate 90 is rabbeted into the door 34. The jamb plate 98 is similarly secured to the opposed face 32*c* of the mullion 32 by screws 112. Again, it is not necessary for the jamb plate 98 to be mortised into the mullion 32. In any case, the door reinforcement projection 96 engages and extends along the interior surface of the door 34*a* (see also FIG. 4). In the illustrated embodiment, the door reinforcement projection 96 is not rabbeted into the door 34, although the principles of the present invention are equally applicable to such an alternative arrangement. On the other hand, the illustrated jamb reinforcement projection 104 is preferably mortised into the interior surface 32*a* of the mullion 32 to underlie the reinforcement projection 80. The reinforcement projections 96 and 104 are preferably rectangular in shape and extend the full length of the plates 90 and 98, respectively. However, the principles of the present invention are equally applicable to various other projection configurations as long as sufficient reinforcement is provided thereby. It is particularly noted that the illustrated projections 96 and 104 extend a sufficient amount along the length of the attachment screws 110 and 112 (see FIG. 2) to provide enough backing (particularly with respect to the jamb projection 104) for significantly reducing the risk of failure at these attachment points. In the illustrated embodiment, the projections extend approximately one-half the length of the screws.

The hinge 84 is preferably formed of a suitable metal material (e.g., steel). If desired, the hinge 84 is formed of extruded metal that is machined or stamped and then rolled (i.e., to form the sleeves).

Figure 7:
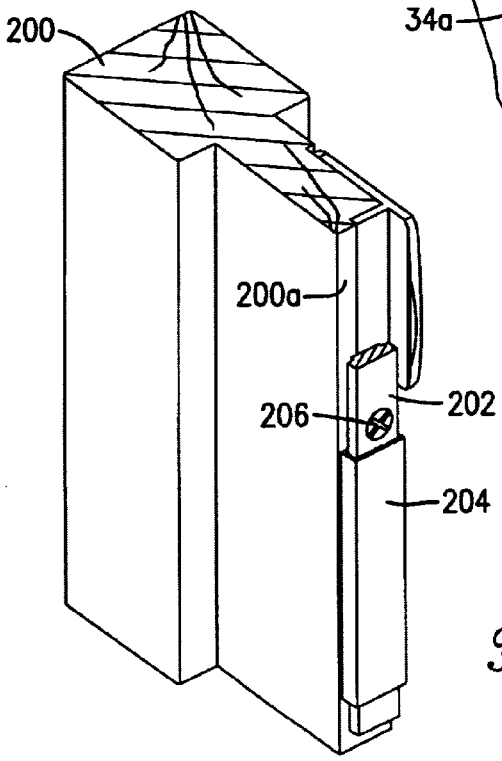
FIG. 7 is a fragmentary perspective view of an alternative embodiment of the present invention, wherein each mullion presented by one of the sidelight assembles and the door assembly comprises a single common jamb.

As shown in FIG. 7, the reinforcement assembly maybe designed for use with various other door constructions. Those ordinarily skilled in the art will appreciate that the mullion 200 is formed of only a single wood piece rather than separate jambs. The illustrated mullion 200 is commonly referred to as a "uni-jamb". As is standard, the width of the interior surface 200*a* of the mullion 200 is approximately one inch. In this regard, the reinforcement plate 202 and decorative cover 204 have lateral dimensions that are substantially less than those of the embodiment shown in FIGS. 1–6. For example, the reinforcement plate 202 preferably has a lateral dimension of approximately one-half inch and is attached by only a single row of attachment screws 206.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A door assembly comprising:

a door frame including a pair of spaced apart jambs, with each of said jambs including opposite interior and exterior surfaces, at least one of said jambs including a bolt-receiving opening spaced between the interior and exterior surfaces thereof;

a door swingably mounted on the frame for swinging movement into and out of a closed position, with the door swinging past one of the surfaces of said at least one of said jambs as the door moves into and out of the closed position;

a bolt shiftably mounted to the door and being receivable within the bolt-receiving opening when the door is in the closed position;

an elongated reinforcement plate having a pair of outwardly facing side faces with a recess being formed in at least one of said side faces, said reinforcement plate secured against said one of the surfaces of said at least one of the jambs, with at least a portion of the reinforcement plate being visible;

a strike plate including a substantially flat body and a bolt-receiving hole defined in the body, with the bolt-receiving hole being at least substantially aligned with the bolt-receiving opening and configured to receive the bolt therein, said strike plate including a cam element that projects from the body and is adapted to engage the bolt as the door moves into the closed position, said strike plate including a projection that extends generally transversely from the body between the cam element and the bolt-receiving hole, said projection engaging said reinforcement plate and extending along said one surface so as to be disposed between the reinforcement plate and said one surface; and a decorative cover retained on the reinforcement plate in an overlying relationship relative thereto so that the visible portion of the reinforcement plate is at least substantially concealed from view.

2. The door assembly as claimed in claim 1, said decorative cover being formed of a paint grade plastic.

3. The door assembly as claimed in claim 1, said decorative cover including an outer stainable faux wood laminate.

4. The door assembly as claimed in claim 1, said cam element projecting outwardly beyond said one surface of said at least one jamb.

5. The door assembly as claimed in claim 1;

a second elongated reinforcement plate secured against one of the surfaces of the other jamb, with at least a portion of the second reinforcement plate being visible; and a second decorative cover retained on the second reinforcement plate in an overlying relationship relative thereto so that the visible portion of the second reinforcement plate is at least substantially concealed from view.

6. The door assembly as claimed in claim 1; and a sidelight assembly extending alongside said one of the jambs of the door assembly.

7. The door assembly as claimed in claim 1, said reinforcement plate extending along the full length of said one of the jambs.

8. The door assembly as claimed in claim 7, said reinforcement plate being formed of metal.

9. The door assembly as claimed in claim 1, said decorative cover and reinforcement plate being configured in such a manner that the decorative cover is automatically retained on the reinforcement plate when the decorative cover is positioned in said overlying relationship.

10. The door assembly as claimed in claim 9, said visible portion of the reinforcement plate including a flat front face and said pair of side faces extending rearwardly from the front face, the other of said side faces including a recess spaced from the front face.

11. The door assembly as claimed in claim 10, said decorative cover comprising a flexible elongated body that includes a longitudinally extending front wall and a pair of spaced apart side walls projecting rearwardly from opposite side margins of the front wall to receive the reinforcement plate therebetween, said flexible elongated body further including a pair of lips that extend inwardly toward one another from the side walls, with each of the lips being received in a corresponding one of the recesses to thereby retain the decorative cover on the reinforcement plate.

12. The door assembly as claimed in claim 11, said front and side walls presenting corresponding outer surfaces that are substantially flat.

13. The door assembly as claimed in claim 11, said recesses extending the full length of the reinforcement plate, said decorative cover and reinforcement plate being coextensive, with said lips extending the full length of the decorative cover.

14. The door assembly as claimed in claim 11, each of said side walls presenting a rear edge spaced from the front wall, with each of the lips projecting from the rear edge of the corresponding side wall.

15. The door assembly as claimed in claim 1, said jambs cooperatively presenting opposed faces between which the door is located when in the closed position, each of said opposed faces being defined between the exterior and interior surfaces of the respective jamb, said bolt-receiving opening disposed in the opposed face of said at least one jamb.

16. A door assembly comprising:

a door frame including a pair of spaced apart first and second jambs, with each of said jambs including opposite interior and exterior surfaces, said first jamb including a bolt-receiving opening spaced between the interior and exterior surfaces thereof;

a door swingably mounted on the frame for swinging movement into and out of a closed position, with the door swinging past one of the surfaces of the first jamb as the door moves into and out of the closed position;

a bolt shiftably mounted to the door and being receivable within the bolt-receiving opening when the door is in the closed position;

an elongated reinforcement plate having a pair of outwardly facing side faces with a recess being formed in at least one of said side faces, said reinforcement plate secured against one of the surfaces of the second jamb, with at least a portion of the reinforcement plate being visible;

a door hinge swingably mounting the door on the second jamb, with the door hinge including a jamb attachment member, said jamb attachment member including a jamb plate fastened to the second jamb and a projection extending generally transversely from the jamb plate, said projection directly engaging said reinforcement plate and extending along said one surface of the second jamb so as to be disposed between the reinforcement plate and said one surface of the second jamb; and a decorative cover retained on the reinforcement plate in an overlying relationship relative thereto so that the visible portion of the reinforcement plate is at least substantially concealed from view.

17. The door assembly as claimed in claim 16, said jambs cooperatively presenting opposed faces between which the door is located when in the closed position, each of said faces being defined between the exterior and interior surfaces of the respective jamb, said bolt-receiving opening disposed in the face of the first jamb, said door presenting an outer face that is opposite the face of the second jamb when the door is in the closed position, said door having opposite interior and exterior surfaces, said outer face of the door being defined between the interior and exterior surfaces thereof, said door hinge including a door attachment member including a door plate pivotally interconnected with the jamb plate and fastened to the outer face of the door, said jamb plate being fastened to the face of the second jamb.

18. The door assembly as claimed in claim 17, said projection being mortised in to the interior surface of the second jamb.

19. The door assembly as claimed in claim 17, said door attachment member including a reinforcement projection that projects transversely from the door plate and engages and extends along the interior surface of the door.

20. The door assembly as claimed in claim 17, said jamb plate presenting opposite sides, said projection being positioned between the sides of the jamb plate.

21. The door assembly as claimed in claim 20, said attachment members each including a sleeve that presents an axial pin-receiving opening; and a pivot pin received in the pin-receiving opening of each sleeve so as to interconnect but permit relative swinging of the attachment members.

22. The door assembly as claimed in claim 21, said jamb plate having the sleeve projecting from one of the sides of the jamb plate and a plurality of screw-receiving openings defined therein between the projection and the other side of the jamb plate.

23. The door assembly as claimed in claim 16, and a sidelight assembly extending alongside the second jamb of the door assembly.

24. The door assembly as claimed in claim 16, said reinforcement plate extending along the full length of the second jamb.

25. The door assembly as claimed in claim 24, said reinforcement plate being formed of metal.

26. The door assembly as claimed in claim 16, said decorative cover being formed of a paint grade plastic.

27. The door assembly as claimed in claim 16, said decorative cover including an outer stainable faux wood laminate.

28. The door assembly as claimed in claim 16, said decorative cover and reinforcement plate being configured in such a manner that the decorative cover is automatically retained on the reinforcement plate when the decorative cover is positioned in said overlying relationship.

29. The door assembly as claimed in claim 28, said visible portion of the reinforcement plate including a flat front face and said pair of side faces extending rearwardly from the front face, the other of said side faces including a recess spaced from the front face.

30. The door assembly as claimed in claim 29, said decorative cover comprising a flexible elongated body that includes a longitudinally extending front wall and a pair of spaced apart side walls projecting rearwardly from opposite side margins of the front wall to receive the reinforcement plate therebetween, said body further including a pair of lips that extend inwardly toward one another from the side walls, with each of the lips being received in a corresponding one of the recesses to thereby retain the decorative cover on the reinforcement plate.

31. The door assembly as claimed in claim 30, said front and side walls presenting corresponding outer surfaces that are substantially flat.

32. The door assembly as claimed in claim 30, said recesses extending the full length of the reinforcement plate, said decorative cover and reinforcement plate being coextensive, with said lips extending the full length of the decorative cover.

33. The door assembly as claimed in claim 30, each of said side walls presenting a rear edge spaced from the front wall, with each of the lips projecting from the rear edge of the corresponding side wall.

34. The door assembly as claimed in claim 16;

a second elongated reinforcement plate secured against said one surface of the first jamb, with at least a portion of the second reinforcement plate being visible; and a second decorative cover retained on the second reinforcement plate in an overlying relationship relative thereto so that the visible portion of the second reinforcement plate is at least substantially concealed from view.

* * * * *